US005992960A

United States Patent [19]

Wolanin

[11] Patent Number: 5,992,960

[45] Date of Patent: Nov. 30, 1999

[54] MULLION BAR RETAINER ARRANGEMENT FOR A REFRIGERATOR CABINET

[75] Inventor: Gerald L. Wolanin, Galesburg, Ill.

[73] Assignee: Maytag Corporation, Newton, Iowa

[21] Appl. No.: 09/096,580

[22] Filed: Jun. 12, 1998

[51] Int. Cl.[6] ..... A47B 96/04

[52] U.S. Cl. ..... 312/407; 312/406.2; 312/265.5

[58] Field of Search ..... 312/265.5, 400, 312/401, 406, 406.2, 407, 257.1; 52/656.9, 656.8, 665, 456; 62/441, 447

[56] References Cited

U.S. PATENT DOCUMENTS

| | | | |
|---|---|---|---|
| 3,619,482 | 11/1971 | Boor | 312/406 X |
| 3,835,660 | 9/1974 | Franck . | |
| 3,868,152 | 2/1975 | Dixon . | |
| 3,933,398 | 1/1976 | Haag . | |
| 3,942,853 | 3/1976 | Grimm et al. . | |
| 3,984,223 | 10/1976 | Whistler, Jr. . | |
| 3,989,329 | 11/1976 | Benford . | |
| 4,120,550 | 10/1978 | Sherburn . | |
| 4,150,518 | 4/1979 | Truesdell et al. . | |
| 4,330,310 | 5/1982 | Tate, Jr. et al. . | |
| 4,348,068 | 9/1982 | Hawkins et al. . | |
| 4,496,072 | 1/1985 | Fleck | 312/406.2 X |
| 4,548,049 | 10/1985 | Rajgopal . | |
| 4,550,576 | 11/1985 | Tate, Jr. et al. . | |
| 4,558,503 | 12/1985 | Wilson . | |
| 4,765,696 | 8/1988 | Cordill et al. . | |
| 4,801,181 | 1/1989 | Cordill et al. . | |
| 4,821,399 | 4/1989 | Markley et al. . | |
| 4,862,577 | 9/1989 | Cordill et al. . | |
| 4,884,415 | 12/1989 | Mandel et al. | 312/407 X |
| 4,914,341 | 4/1990 | Weaver et al. . | |
| 4,941,289 | 7/1990 | Rolek . | |
| 4,955,676 | 9/1990 | Weaver et al. . | |
| 5,033,182 | 7/1991 | Winterheimer et al. . | |
| 5,174,640 | 12/1992 | Kuwahara et al. | 312/407 |
| 5,255,531 | 10/1993 | Williams et al. . | |
| 5,349,832 | 9/1994 | Johnson et al. . | |
| 5,584,551 | 12/1996 | Jenkins . | |
| 5,720,536 | 2/1998 | Jenkins et al. | 312/407 X |
| 5,725,294 | 3/1998 | Froelicher | 312/406 X |

*Primary Examiner*—Peter M. Cuomo
*Assistant Examiner*—Hanh V. Tran
*Attorney, Agent, or Firm*—Everett G. Diederiks, Jr.

[57] ABSTRACT

A mullion bar is attached to a cabinet shell of a refrigerator through the use of a retainer that includes a first body portion positioned between primary and secondary flanges formed by the cabinet shell and a second body portion that is interengaged with additional flange structure defined by the mullion bar. More specifically, the retainer is preferably formed as an integral plastic element, with the first body portion being defined by a pair of spaced, generally T-shaped body members that are frictionally interposed between a return flange and a secondary flange of the cabinet shell. The second body portion of the retainer includes a bridge member that interconnects the body members, as well as a pair of legs which project in a direction opposite of the body members and which mate with the additional flange structure of the mullion bar. The bridge member has an upper surface that conforms to a lower curved surface of the cabinet shell flange structure and a lower surface that conforms to a terminal end of the mullion bar in order to provide a smooth, aesthetically appealing front cabinet surface arrangement with the forwardmost flange structure of the cabinet shell being arranged coplanar with the mullion bar and with the bridge member of the retainer being interposed between the cabinet shell and the mullion bar. Provisions are also made for the routing of a yoder tube between the spaced body members of the retainer and behind the mullion bar.

15 Claims, 4 Drawing Sheets

MULLION BAR RETAINER ARRANGEMENT FOR A REFRIGERATOR CABINET

BACKGROUND OF THE INVENTION

1. Field of the Invention

The present invention generally relates to a refrigerated cabinet and, more specifically, to the mounting of a mullion bar extending along a partition between two compartments of a refrigerator cabinet.

2. Discussion of the Prior Art

A conventional refrigerator is defined by insulated freezer and fresh food compartments which are disposed in either a side-by-side or a vertically spaced configuration. Generally, integrally molded fresh food and freezer liners are used for defining interior storage compartments of the cabinet. More specifically, the conventional refrigerator cabinet is typically defined by an outer shell that is formed from sheet metal to which is attached, at a front face portion thereof, a mullion bar that partitions the shell into two sections. Each of the fresh food and freezer liners are inserted into a respective cabinet section while being mated with return flange portions of both the cabinet shell and the mullion bar.

FIG. 1 illustrates, in a cross-sectional view, a typical prior art side-by-side refrigerator cabinet front flange design and the manner in which a mullion bar is typically attached thereto. As shown in FIG. 1, the side-by-side refrigerator cabinet includes an outer metal shell 3' having a top panel portion that is bent, typically through a roll-forming process, so as to define a front face primary flange 47'. The cabinet shell 3' returns sharply back behind the primary flange 47' and is again roll-formed to create secondary flange 61' that is spaced from the primary flange 47' by a cavity.

A mullion bar 11' is provided at an upper terminal end thereof with a slight bend so that it may abut against the primary flange 47' while the terminal end extends within the cavity defined between the primary and secondary flanges 47' and 61'. As clearly shown in FIG. 1, the primary flange 47' supports the mullion bar 11' in one direction, i.e., it limits movement of the mullion bar in a direction away from the secondary flange 61'. A yoder tube (not shown) is positioned between the upper terminal end of the mullion bar 11' and the secondary flange 61' in order to prevent the mullion bar 11' from moving in a direction away from the primary flange 47'. Of course, as is known in the art, the yoder tube is designed to run along the mullion bar 11' and provides an inexpensive and efficient heat transfer arrangement whereby the heat of condensation of the hot refrigeration gases is used to prevent condensation of moisture adjacent the front door openings of the freezer and fresh food compartments.

There are several problems associated with this prior art configuration. For instance, the only member preventing the mullion bar 11' from moving away from the primary flange 47' is the arrangement of the yoder tube between the mullion bar 1I1' and the secondary flange 61'. Often the yoder tube cannot sufficiently retain the mullion bar 11' in the desired position and the mullion bar 11' moves away from the primary flange 47' such that a non-flush assembly is created between the parts. In addition, unless extreme tolerances are maintained, there is nothing to stop the mullion bar 11' from sliding downward along the primary flange 47' to create a gap Y between the terminal edge of the primary flange 3' and the bent portion of the mullion bar 11'. Not only is such a poorly fitted part unsightly, but it can create problems when the refrigerator cabinet is insulated in the wall spaces between the liners and the outer shell 3'. More specifically, once the mullion bar 11', yoder tube and cabinet liners are in place, foamed insulation is injected between the cabinet shell 3' and the liners and the insulation will tend to leak during the foaming process if there is any vertical gap between the cabinet shell 3' and mullion bar 11' or if the mullion bar 11' shifts in the direction of secondary flange 61'.

Based on the above, there exists a need in the art for an improved arrangement for attaching a mullion bar to the primary flange of a refrigerator cabinet shell. More specifically, there exists a need for an retainer arrangement which will securely hold the mullion bar in place, while providing for a flush connection between the cabinet shell and the mullion bar, in order to reduce or eliminate foam leakage during the cabinet foaming process. In addition, there is a need for a mullion bar retainer arrangement that is specifically designed to accommodate the mounting of a yoder tube in a secure and reliable manner.

SUMMARY OF THE INVENTION

It is therefore an object of the present invention to provide, in a refrigerator having freezer and fresh food compartments, an improved connection between the outer shell of the refrigerator cabinet and the mullion bar.

It is another object of the invention to provide a mullion bar retainer which forms a transition from the outer shell of the refrigerator to the mullion bar and securely holds the mullion bar in place while providing a flush connection between the outer shell and the mullion bar.

It is a further object of the invention to provide a connection between the outer shell of a refrigerator and the mullion bar which will prevent the leakage of insulation that is foamed in-situ between liners of the refrigerator and the cabinet shell.

It is a still further objective of the invention to provide a mullion bar retainer arrangement that is specifically designed to enhance the mounting of a yoder tube within the refrigerator cabinet.

These and other objects of the invention are realized by providing a mullion bar retaining arrangement for use in mounting a mullion bar to a refrigerator cabinet shell including a mullion bar retainer formed with multiple, specialized surfaces that are adapted to respectively abut against return and secondary flanges of the cabinet shell and to join the mullion bar to the cabinet shell while providing a smooth, aesthetically appealing front cabinet surface portion that includes the primary flange, the mullion bar retainer and the mullion bar.

In accordance with a preferred embodiment of the invention, the mullion bar retainer includes a curved portion which conforms to the shape of a lower terminal end of the primary flange, as well as a pair of spaced ribs which are adapted to extend within the cavity defined between the primary and secondary flanges and to bear against the secondary flange in order to prevent any fore-to-aft movement of the retainer relative to the cabinet shell. The space provided between the ribs is specifically adapted to accommodate the yoder tube. In addition, the mullion bar retainer is formed with a pair of leg members which are adapted to be inserted into cooperating slots of the mullion bar to secure the mullion bar in a desired position. With this arrangement, the mullion bar retainer securely mates with the cabinet shell and the mullion bar to thereby provide extremely tight tolerances and minimal gaps between the primary flange of the cabinet shell and the mullion bar retainer and between the mullion bar retainer and the mullion bar itself, while providing an efficient and cost effective cabinet assembly configuration.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
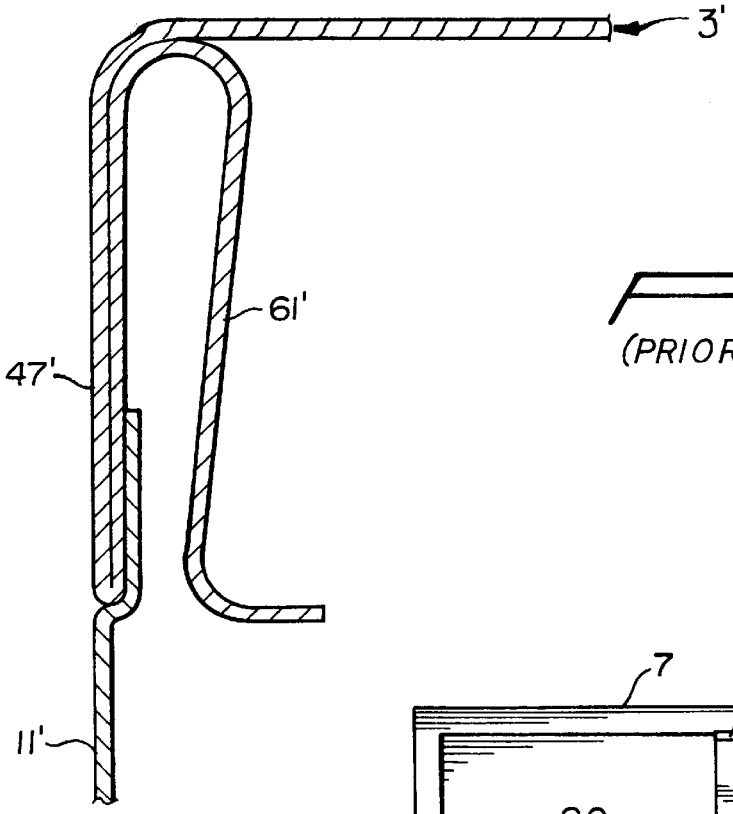
FIG. 1 (PRIOR ART)
FIG. 1 is a partial, cross-sectional view of a mullion bar to cabinet shell connection utilized in a prior art refrigerator design.
Figure 2:
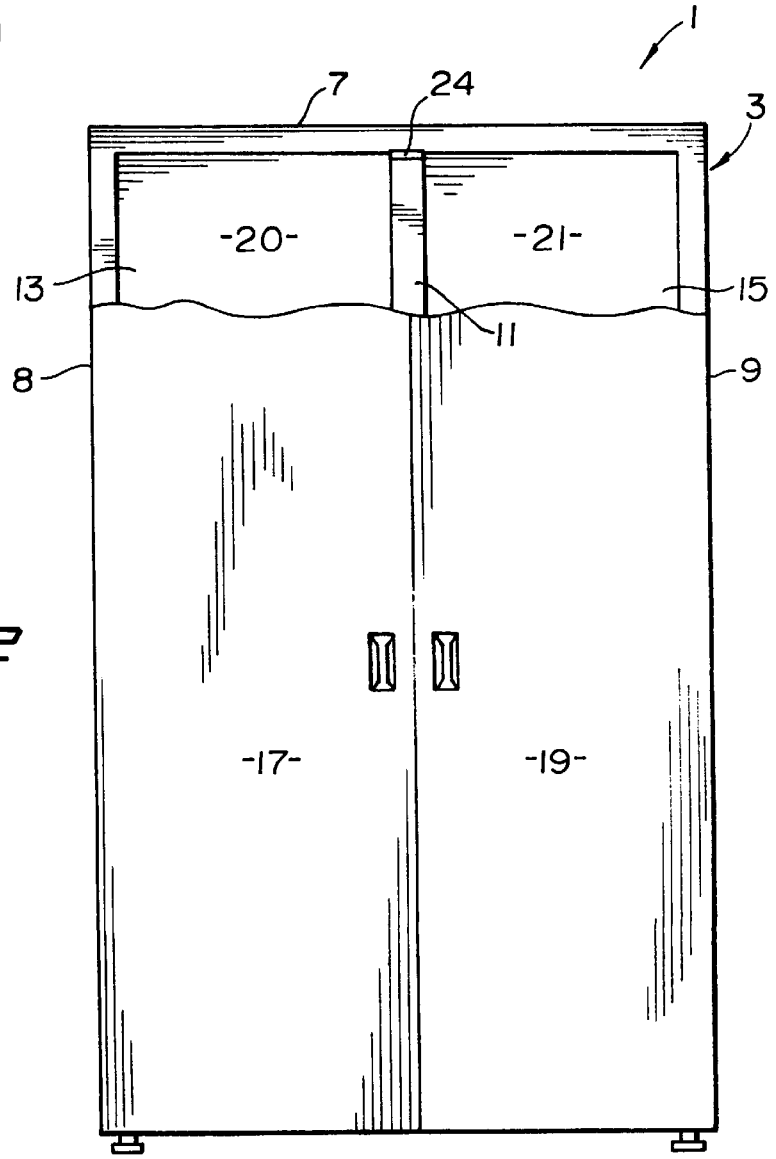
FIG. 2 is a front view of a side-by-side refrigerator, shown with the doors of the fresh food and freezer compartment being cut away to reveal the mullion bar retaining arrangement of the present invention.

With initial reference to FIG. 2, a preferred embodiment of the mullion bar retainer arrangement of the present invention is shown for use in a side-by-side refrigerator cabinet 1. In a manner known in the art, cabinet 1 includes an outer shell 3 that includes a top panel 7, a pair of opposed side panels 8 and 9 and a rear panel (not shown). A vertically extending partition in the form of a mullion bar 11 is provided adjacent the front of cabinet 1 and aids in dividing the interior of cabinet 1 into a freezer compartment 13 and a fresh food compartment 15. As shown, freezer compartment 13 is provided with a door 17 that is hinged at the outer edge of cabinet 1 for swing movement about a vertical pivot axis and fresh food compartment 15 is likewise provided with a similar door 19 that is also hinged along an opposed edge of cabinet 1 for swinging movement about a vertical pivot axis. The freezer and fresh food compartments 13 and 15 are actually defined by a pair of spaced liners 20 and 21 (also see FIG. 3) that are mounted within cabinet 1. As the general construction and mounting of doors 17 and 19, as well as liners 20 and 21, are known in the art and are not considered part of the present invention, they will not be further discussed herein. Instead, the present invention is directed to the manner in which mullion bar 11 is interconnected to cabinet shell 1 through the use of a mullion bar retainer 24, the construction and manner of use of which will be detailed more fully below.

Figure 3:
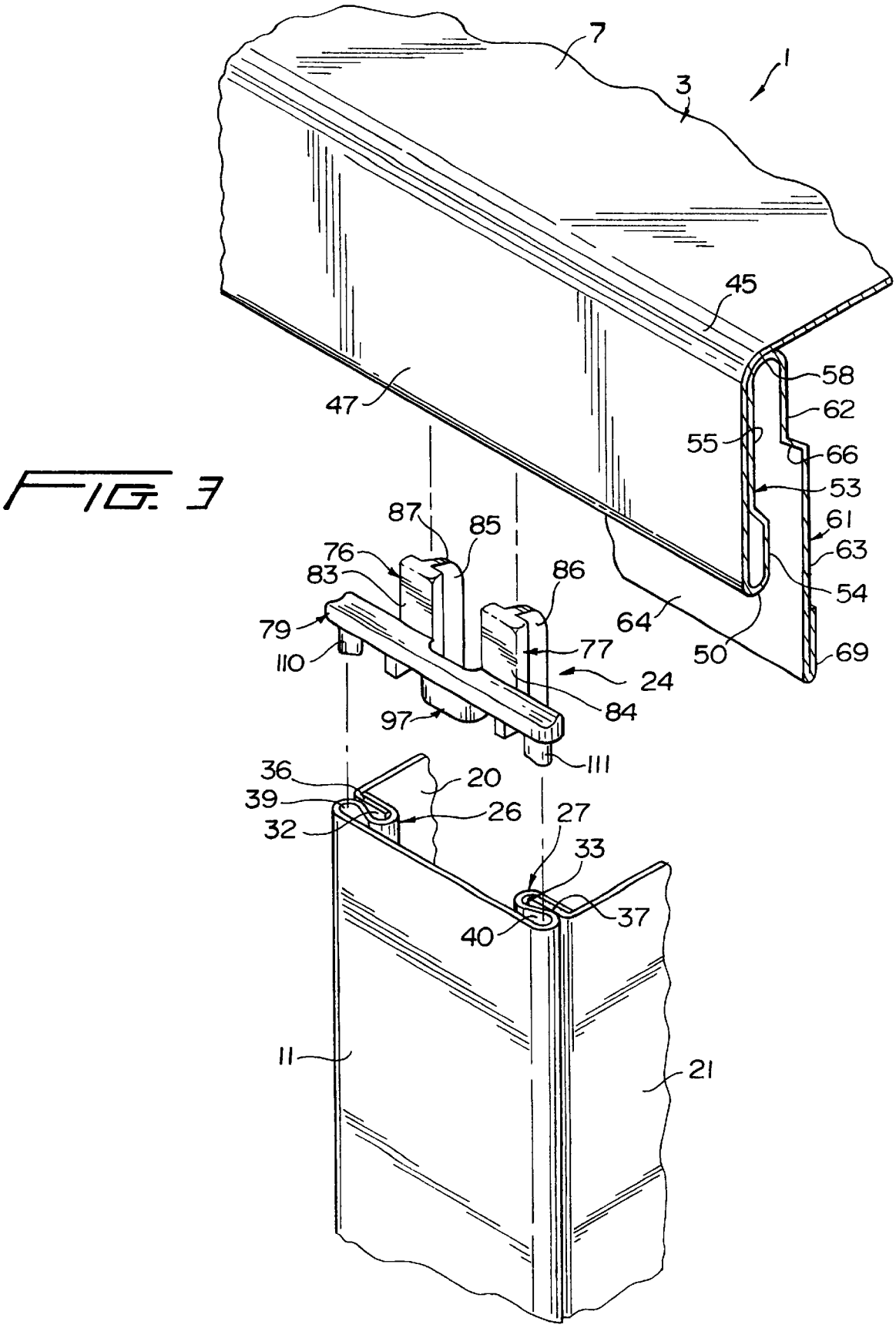
FIG. 3 is a partial exploded view of the upper front cabinet flange, mullion bar, mullion bar retainer and fresh food and freezer liners of the side-by-side refrigerator of FIG. 2.

FIG. 3 will now be referenced in describing the preferred construction of cabinet 1 and mullion bar 11 which facilitates their interconnection through retainer 24. Mullion bar 11, which is preferably formed from sheet metal but which could be formed from other materials including plastic, is provided, along each of its longitudinal edges, with reversing flange structure generally indicated at 26 and 27 respectively. Reversing flange structures 26 and 27 have oppositely directed, generally S-shaped transverse configurations. With this construction, reversing flange structures 26 and 27 define a pair of elongated, aft slots 32 and 33 respectively. Slots 32 and 33 are adapted to receive out-turned flanges 36 and 37 of freezer and fresh food liners 20 and 21 as shown in this figure. Of course, this interconnection between mullion bar 11 and liners 20 and 21 occurs after mullion bar 1 1 is attached to cabinet 1. For this purpose, reversing flange structures 26 and 27 also define forwardmost slots 39 and 40 respectively, which are adapted to receive a portion of mullion bar retainer 24 in a manner which will be detailed further below.

Before detailing the engagement of mullion bar 11 to cabinet 1 through mullion bar retainer 24, reference will be made to FIGS. 3–5 in describing the preferred construction of outer shell 3. With outer shell 3 being preferably made from sheet metal, top panel 7 of refrigerator cabinet 1 is roll-formed to define a curved, upper transverse edge 45 leading to a front face or primary flange 47 of outer shell 3. Outer shell 3 is then roll-formed to define a lower, arcuate transition portion 50 that leads to a first return flange portion 53. Although further discussed below, it should be noted at this point that lower, arcuate transition portion 50 defines a surface which is adapted to mate with a portion of mullion bar retainer 24. First return flange portion 53 is actually defined by a first section 54 that is spaced rearwardly, in a generally open-loop configuration, from primary flange 47 and a second section 55 which is arranged directly adjacent primary flange 47. At an inner surface portion of curved upper transverse edge 45, first return flange 53 is roll-formed at 58 and leads to a secondary flange 61. Secondary flange 61 actually includes a first section 62, a second section 63 and an extension section 64. First and second sections 62 and 63 are interconnected by an angled portion 66 as clearly depicted in this figure. In accordance with the preferred embodiment, outer shell 3 terminates in a second return flange portion 69 that is arranged directly behind extension section 64.

Next, reference will be made to FIGS. 3 and 6–9 in describing the preferred construction of mullion bar retainer 24. As shown in these figures, mullion bar retainer 24 includes two elongated body members 76 and 77 that generally extend in a first axial direction. Body members 76 and 77 are interconnected by a lateral bridge member 79 which extends transverse to the first axial direction. Elongated body members 76 and 77 include respective front bearing surfaces 83 and 84 and are formed with rearwardly protecting fins 85 and 86 respectively. In the preferred embodiment, fin 85 includes a sloped portion 87 that leads to a rear bearing surface portion 89 (see FIGS. 8 and 9). In a similar manner, fin 86 includes a sloped portion 91 that leads to a rear bearing surface portion 93 for elongated body member 77. Elongated body members 76 and 77 are also joined by a connection portion 97 having a contoured rear surface 99 that leads up to and extends into an upper surface 103 of lateral bridge member 79. In accordance with the preferred embodiment, upper surface 103 is concave in side-view as can be clearly seen in FIG. 8. More specifically, the curvature of upper surface 103 is particularly designed to conform to the curvature of lower, arcuate transition portion 50 of outer shell 3 as will be discussed more fully below.

Lateral bridge member 79 also defines a lower abutment surface 105 and a front face 107. In addition, at outer lateral ends thereof, bridge member 79 is connected to a pair of downwardly extending legs 110 and 111. Although legs 110 and 11 can take various cross-sectional shapes in accordance with the present invention, in the preferred embodiment, legs 110 and 111 are generally teardrop-shaped to conform to the shape of the forwardmost slots 39 and 40 of mullion bar 11. At this point, it should be realized that the relative length of elongated body members 76 and 77, connection portion 97 and legs 110 and 111 can vary from that shown in the drawings without departing from the spirit of the invention. For example, instead of extending substantially equal distances from lateral bridge member 79 (in the order of ¼" in the embodiment shown), legs 110 and 111 could be shortened to reduce stresses and the probability of breakage during assembly and elongated body members 76 and 77 could be even further elongated to provide further stability. Such potential modifications are illustrated by dotted lines in FIG. 6 in depicting elongated body members 76*a* and 77*a* being extended to approximately ½" and legs 110*a* and 111*a* being shortened to approximately 5/32", while tapering on their inner surfaces. In any event, potential modifications within the scope of the invention will become more readily apparent after reading the following discussion on the assembly of refrigerator cabinet 1.

During assembly of refrigerator cabinet 1, mullion bar retainer 24 is interposed between mullion bar 11 and outer shell 3 with legs 110 and 111 being snugly received within forwardmost slots 39 and 40 and with lower surface 105 of lateral bridge member 79 abutting mullion bar 11. In addition, elongated body members 76 and 77 of mullion bar retainer 24 are positioned between primary flange 47 and secondary flange 61 (see FIGS. 4 and 5). More specifically, front bearing surfaces 83 and 84 of elongated body members 76 and 77 directly abut first section 54 of first return flange portion 53 and rear bearing surface portions 89 and 93 of elongated body member 76 and 77 directly abut secondary flange 61 as clearly shown in FIG. 5. Elongated body members 76 and 77 are inserted between first return flange portion 53 and secondary flange 61 until upper surface 103 of lateral bridge member 79 abuts lower, arcuate transition portion 50. As indicated above, upper surface 103 is concave in shape and conforms to the convex curvature of lower, arcuate transition portion 50. In this position, front face 107 of lateral bridge member 79 is generally flush with both the front face of outer shell 3 as defined by primary flange 47 and the outer exposed surface of mullion bar 11.

With this construction, mullion bar retainer 24 provides a smooth transition from mullion bar 11 to the roll-formed lower, arcuate transition portion 50 at the bottom of primary flange 47 of outer shell 3. In addition, mullion bar retainer 24 accurately positions mullion bar 11 with respect to outer shell 3 while preventing any relative fore-to-aft movement between the mullion bar 11 and the outer shell 3. Furthermore, the use of mullion bar retainer 24 in accordance with the present invention reduces the chance of any foam leakage during insulation of refrigerator cabinet 1. More specifically, by maintaining conforming surfaces between the primary flange 47, mullion bar retainer 24 and mullion bar 11, when the zone between freezer and fresh food liners 20 and 21 is injected with insulation during a cabinet foaming process, leakage of insulative material in this area of the refrigerator cabinet 1 is prevented. Of course, since both mullion bar 11 and primary flange 47 have respective surfaces which conform to and abut mullion bar retainer 24, an extremely aesthetically appealing mullion bar mounting arrangement is provided in accordance with the present invention.

Figure 4:
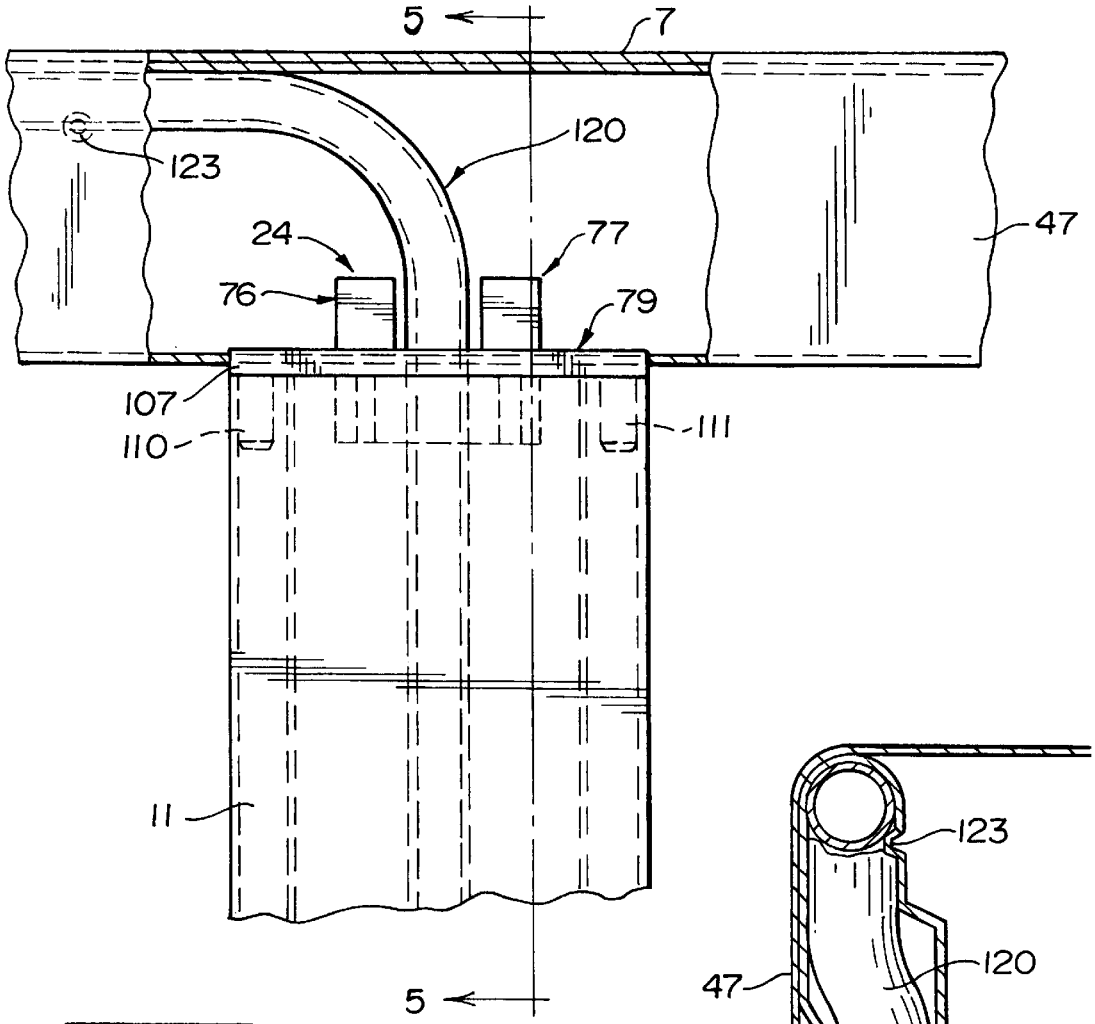
FIG. 4 is a front partial cut-away view of the refrigerator showing the upper front flange, mullion bar retainer, mullion bar and yoder tube incorporated in the refrigerator of FIG. 2.
Figure 5:
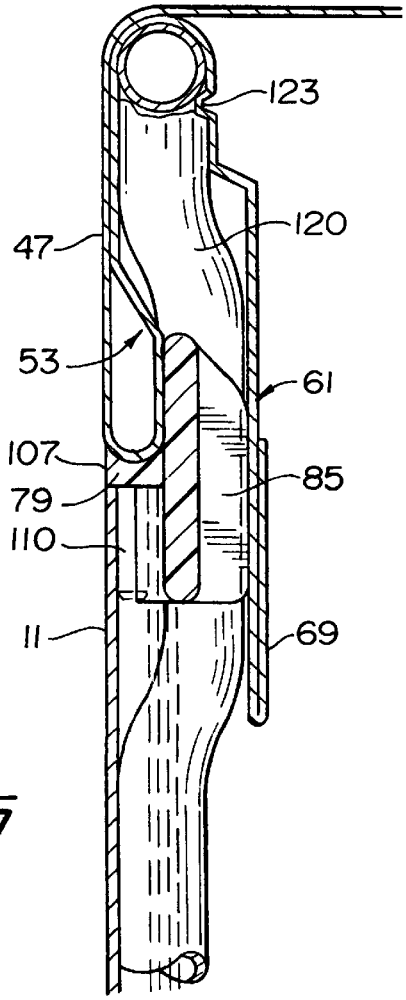
FIG. 5 is a cross-sectional view generally taken along the line V—V in FIG. 4.
Figure 6:
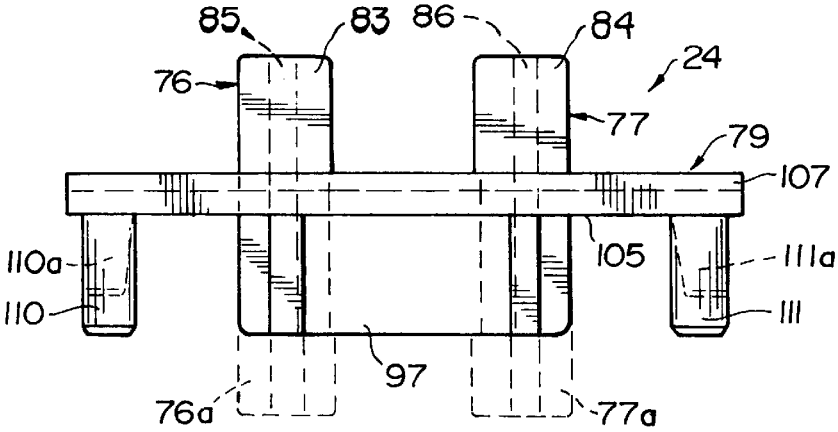
FIG. 6 is a front view of the mullion bar retainer constructed in accordance with a preferred embodiment of the invention.
Figure 8:
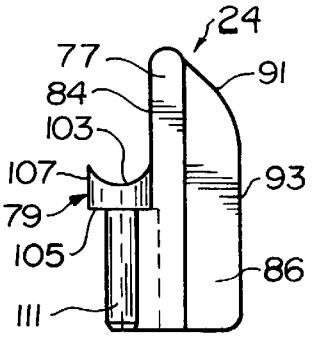
FIG. 8 is a side view of the mullion bar retainer according to the preferred embodiment.
Figure 7:
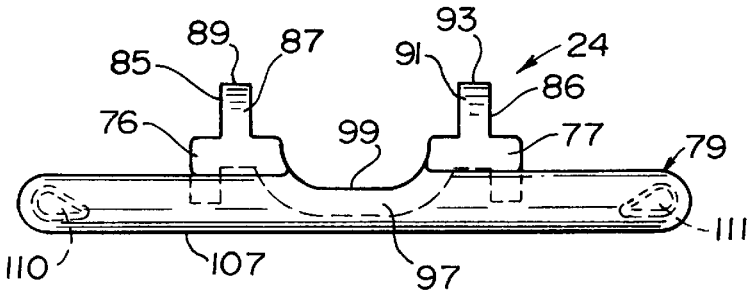
FIG. 7 is a top view of the mullion bar retainer according to the preferred embodiment of FIG. 6.
Figure 9:
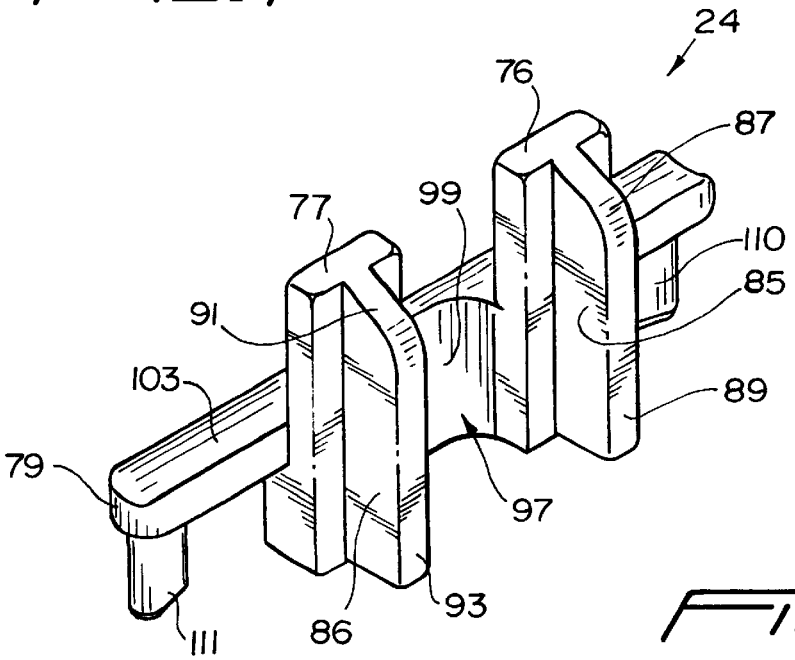
FIG. 9 is a rear perspective view of the mullion bar retainer according to the preferred embodiment of the invention.

As clearly shown in FIGS. 4 and 5, the mullion bar retainer arrangement of the present invention also aids in the routing of a yoder tube generally indicated at 120. As in known in the art, yoder tube 120 enables hot gases from the refrigeration circuit to be circulated adjacent the front door openings of freezer and fresh food compartments 13 and 15 to prevent condensation adjacent these openings. As illustrated in these figures, yoder tube 120 travels along top panel 7 at upper roll-formed section 58 and takes a turn so as to extend downward behind mullion bar 11. In accordance with the invention, first section 62 of secondary flange 61 is preferably provided with one or more projections or bumps 123 to advantageously retain yoder tube 120 in the desired position. Since outer shell 3 is preferably formed from sheet metal, each projection 123 can be readily formed by various methods including stamping of secondary flange 61. As indicated above, mullion bar retainer 24 is preferably formed with a connection portion 97, arranged between elongated body members 76 and 77, having a contoured rear surface 99. Constructing mullion bar retainer 24 in this fashion enables yoder tube 120 to be easily routed through a transition zone defined behind primary flange 47 to behind mullion bar 11. Therefore, yoder tube 120 is accommodated between contoured rear surface 99 of mullion bar retainer 24 and secondary flange 61.

Based on the above, it should be readily apparent that the use of a mullion bar retainer for mounting a mullion bar to a shell of a refrigerator cabinet in accordance with the present invention provides for a more efficient assembly of the overall cabinet structure, enhances the aesthetics of the refrigerator cabinet, aids in routing and properly maintaining the position of a yoder tube and benefits a subsequent cabinet foaming process. However, although the invention has been described in connection with a side-by-side refrigerator, it should be readily apparent that the mullion bar retainer arrangement of the present invention could also be advantageously utilized in various refrigerator models, including top mount units. Therefore, it is to be understood that the form of the invention herein shown and described is to be taken as the preferred embodiment of the invention only and that various changes in shape, material, sizes and arrangement of parts may be resorted to without departing from the spirit of the invention. In general, the invention is only intended to be limited by the scope of the following claims.

I claim:

1. In a refrigerator including a cabinet shell having a forwardmost flange structure, including fore-to-aft spaced primary and secondary flanges, and a mullion bar which defines additional flange structure, with the flange structure of both the cabinet shell and the mullion bar being adapted to receive respective peripheral flange portions of freezer and fresh food liners in order to mount the liners within the cabinet shell so as to define freezer and fresh food compartments of the refrigerator, a retainer for interconnecting the mullion bar to the cabinet shell comprising: a first body portion positioned between the primary and secondary flanges; and a second body portion, said mullion bar being attached to the second body portion with at least a section of the second body portion being interposed between at least the primary flange of the forwardmost flange structure and a terminal end of the mullion bar.

2. The retainer according to claim 1, wherein the forwardmost flange structure further includes a return flange interconnecting the primary and secondary flanges, with the first body portion being positioned between and engaging each of the return and secondary flanges.

3. The retainer according to claim 2, wherein the first body portion of the retainer is frictionally held between the return and secondary flanges.

4. The retainer according to claim 2, farther comprising a flange transition portion interconnecting the primary flange and the return flange, said second body portion of the retainer having a first surface that conforms and mates with the flange transition portion.

5. The retainer according to claim 4, wherein the flange transition portion is convexly curved and the first surface of the second body portion is concavely curved to mate with the flange transition portion.

6. The retainer according to claim 4, wherein the primary flange and the mullion bar have respective frontal surfaces that extend in a common plane.

7. The retainer according to claim 4, wherein the second body portion has a second surface, opposite the first surface, that conforms to the terminal end of the mullion bar.

8. The retainer according to claim 1, wherein the second body portion includes a bridge member and at least one leg projecting from the bridge member, with the at least one leg being interengaged with the additional flange structure of the mullion bar in order to interconnect the retainer and the mullion bar.

9. The retainer according to claim 8, wherein the bridge member has projecting therefrom a pair of spaced legs, with each of the legs being offset from the first body portion.

10. The retainer according to claim 9, wherein each of the legs has a generally tear-drop shape in cross-section.

11. The retainer according to claim 8, wherein the first body portion is constituted by a pair of spaced body members that are attached to and project from the second body portion in a direction opposite to the at least one leg.

12. The retainer according to claim 11, wherein each of the body members is generally T-shaped in cross-section.

13. The retainer according to claim 11, wherein the body members define therebetween a receiving zone through which a yoder tube is adapted to extend.

14. The retainer according to claim 13, wherein the bridge member includes a cut-out portion which defines, at least in part, the receiving zone.

15. The retainer according to claim 11, wherein the retainer is integrally formed of plastic.

* * * * *